US007131159B2

(12) United States Patent
Kim

(10) Patent No.: US 7,131,159 B2
(45) Date of Patent: Nov. 7, 2006

(54) METHOD OF CONTROLLING WOBBLING WASHING MACHINE

(75) Inventor: Hyun-Sook Kim, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 525 days.

(21) Appl. No.: 10/309,135

(22) Filed: Dec. 4, 2002

(65) Prior Publication Data

US 2004/0006830 A1 Jan. 15, 2004

(30) Foreign Application Priority Data

Jul. 9, 2002 (KR) ..... 2002-39694

(51) Int. Cl.
*D06F 37/30* (2006.01)

(52) U.S. Cl. ..... 8/159; 68/134; 68/131; 68/12.02

(58) Field of Classification Search ..... 68/134, 68/131, 12.02
See application file for complete search history.

(56) References Cited

U.S. PATENT DOCUMENTS 2,645,111 A * 7/1953 Fields ..... 68/23.6
2,665,757 A * 1/1954 Stevens et al. ..... 83/210
2,699,660 A * 1/1955 Kirby ..... 68/23.3
2,919,493 A * 1/1960 Candor ..... 34/549
5,373,714 A * 12/1994 Wada ..... 68/12.02
5,460,018 A * 10/1995 Werner et al. ..... 68/23.6
5,680,770 A * 10/1997 Hall et al. ..... 62/293
6,158,072 A * 12/2000 Baek et al. ..... 8/159
6,227,013 B1 * 5/2001 Wyatt-Smith ..... 68/134

FOREIGN PATENT DOCUMENTS

EP 668 389 A1 8/1995
JP 1-268597 * 10/1989
JP 4-176494 * 6/1992
JP 5-137876 * 6/1993
JP 6-182082 * 7/1994
JP 2000-342883 * 12/2000

OTHER PUBLICATIONS

European Patent Office 0 807 706 Nov. 1997.*
European Patent Office 0 837 171 Oct. 1998.*

* cited by examiner

*Primary Examiner*—Frankie L. Stinson
(74) *Attorney, Agent, or Firm*—Staas & Halsey LLP

(57) ABSTRACT

A method of controlling a wobbling washing machine which performs a washing operation, a rinsing operation, and a disentangling operation by wobbling a washing plate. The disentangling operation includes wobbling the washing plate at a speed higher than a wobbling speed of the washing plate for performing the washing or rinsing operation. The method allows a load of laundry to be effectively disentangled by a wobbling action of the washing plate at a motor's rotating speed which is preset to be higher than the motor's rotating speed at the washing or rinsing operation. The method further includes performing the disentangling operation before and after each of a first spin-drying operation and a final spin-drying operation to further minimize tangling of the laundry.

14 Claims, 3 Drawing Sheets

METHOD OF CONTROLLING WOBBLING WASHING MACHINE

CROSS-REFERENCE TO RELATED APPLICATIONS

This application claims the benefit of Korean Patent Application No. 2002-39694 filed on Jul. 9, 2002, in the Korean Intellectual Property Office, the disclosure of which is incorporated herein by reference.

BACKGROUND OF THE INVENTION

1. Field of the Invention

The present invention relates to a method of controlling a wobbling washing machine, and more particularly, to a method of controlling a wobbling washing machine, the method comprising disentangling an entangled item of laundry.

2. Description of the Related Art

Generally, a washing machine having a wobbling device is used to wash laundry by wobbling a washing plate. The washing plate is interiorly installed at a bottom of a spin-drying tub of the washing machine.

Such a washing machine performs a series of operations, including washing, rinsing, and spin-drying operations based on washing information which is variably preset depending on a volume and kind of the laundry. The washing information includes a rotating speed of a motor which wobbles the washing plate, a washing time, a number of rinses, a wash water level, and a spin-drying time.

As the washing, rinsing, and spin-drying operations proceed on the basis of preset information, laundry is entangled, and wrinkles are formed on the laundry.

In the conventional washing machine, the motor's rotating speed at a disentangling operation to disentangle the laundry is equal to the motor's rotating speed at the washing or rinsing operation. Accordingly, it is difficult to disentangle the laundry.

Furthermore, the disentangling operation is performed only after a final spin-drying operation is completed. In such a case, tangled laundry is not effectively and sufficiently disentangled.

SUMMARY OF THE INVENTION

Accordingly, it is an object of the present invention to provide a method of controlling a washing machine so as to effectively disentangle a load of laundry by wobbling a washing plate at a motor's rotating speed which is preset to be higher than a motor's rotating speed at a washing or rinsing operation.

Another object of the present invention is to minimize a tangling of the laundry by performing a disentangling operation before and after each of a first spin-drying operation and a final spin-drying operation.

Additional objects and advantages of the invention will be set forth in part in the description which follows and, in part, will be obvious from the description, or may be learned by practice of the invention.

To achieve the above and other objects of the present invention, there is provided a method of controlling a wobbling washing machine having a washing plate and a motor which wobbles the washing plate, the method comprising performing a washing operation to wash laundry including wobbling the washing plate, performing a rinsing operation to rinse the laundry including wobbling the washing plate, and performing a disentangling operation to disentangle the laundry by wobbling the washing plate, wherein the wobbling of the washing plate during the disentangling operation is performed at a higher wobbling speed than that of the rinsing or the washing operation.

BRIEF DESCRIPTION OF THE DRAWINGS

These and other objects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
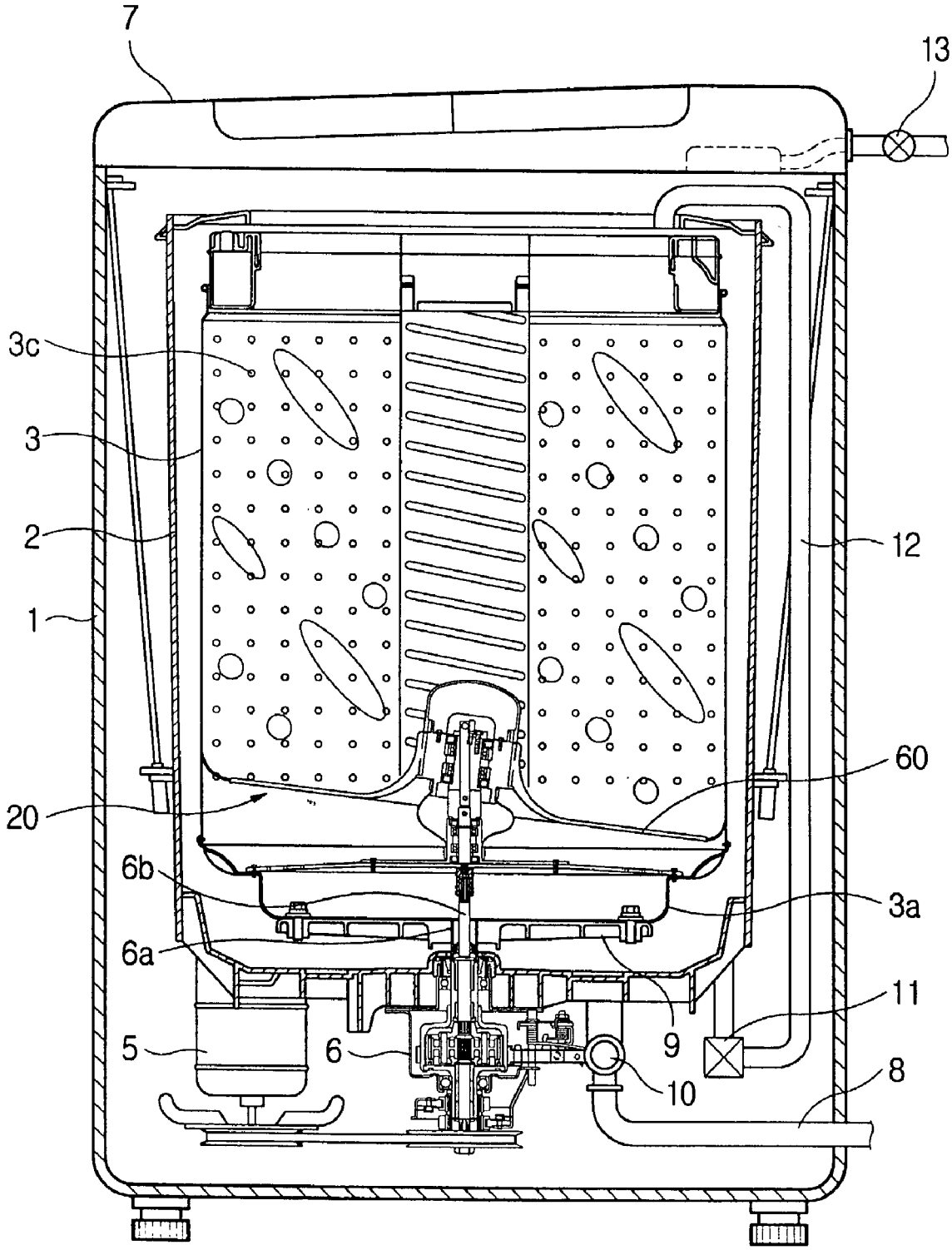
FIG. 1 is a side sectional view illustrating the interior of a wobbling washing machine according to an embodiment of the present invention.

Reference will now be made in detail to the embodiments of the present invention, examples of which are illustrated in the accompanying drawings, wherein like reference numerals refer to the like elements throughout. The embodiments are described below in order to explain the present invention by referring to the figures.

FIG. 1 shows a side sectional view of a wobbling washing machine ("washing machine") according to an embodiment of the present invention.

The terms described as a "wobbling position" and a "level position" herein may be defined as follows. That is, the "wobbling position" means that a washing plate 60 of the washing machine is slantly positioned by a wobbling device 20 so as to be wobbled in a vertical direction. In contrast, the "level position" means that the washing plate 60 is horizontally positioned by the wobbling device 20 so as to be prevented from wobbling.

As shown in FIG. 1, the washing machine further includes a cabinet 1 and a water tub 2 which is vertically set in the cabinet 1. A spin-drying tub 3 is concentrically set in the water tub 2, and is perforated on its sidewall to have a plurality of perforations 3*c*. The washing machine also includes a drive motor 5 and a power transmission unit 6, which are installed in a space between a bottom of the water tub 2 and a lower portion of the cabinet 1. The wobbling device 20 is set in the spin-drying tub 3.

A drain hose 8 is installed under the water tub 2, and extends to the outside of the cabinet 1 to drain wash water from the water tub 2 after, for example, a washing operation. A pump motor 11 and a water recovery pipe 12 are provided in the washing machine and raise the wash water from the bottom to a top of the water tub 2 so as to reduce consumption of water. A water supply valve 13 is installed at a predetermined position on a water supply pipe which is connected to a water tap (not shown).

A spin-drying shaft support 9 is exteriorly mounted to a bottom 3*a* of the spin-drying tub 3. A spin-drying shaft 6*a* of the power transmission unit 6 is mounted at a center of the spin-drying shaft support 9 and rotates the spin-drying tub 3. A washing shaft 6*b* is set in the spin-drying shaft 6*a*. In this case, the washing shaft 6*b* further extends from a top end of the spin-drying shaft 6*a* so as to have an upper end of the washing shaft 6*b* be connected to the wobbling device 20.

The wobbling device 20 is interiorly mounted to the bottom 3*a* of the spin-drying tub 3. Where the washing plate 60 is set in the wobbling position, that is, it is slantly positioned, the laundry is washed while being wobbled in a vertical direction. Where the washing plate 60 is set at the level position, that is, it is horizontally positioned, the washing plate 60 is rotated along with the spin-drying tub 3 for spin-drying the laundry.

Figure 2:
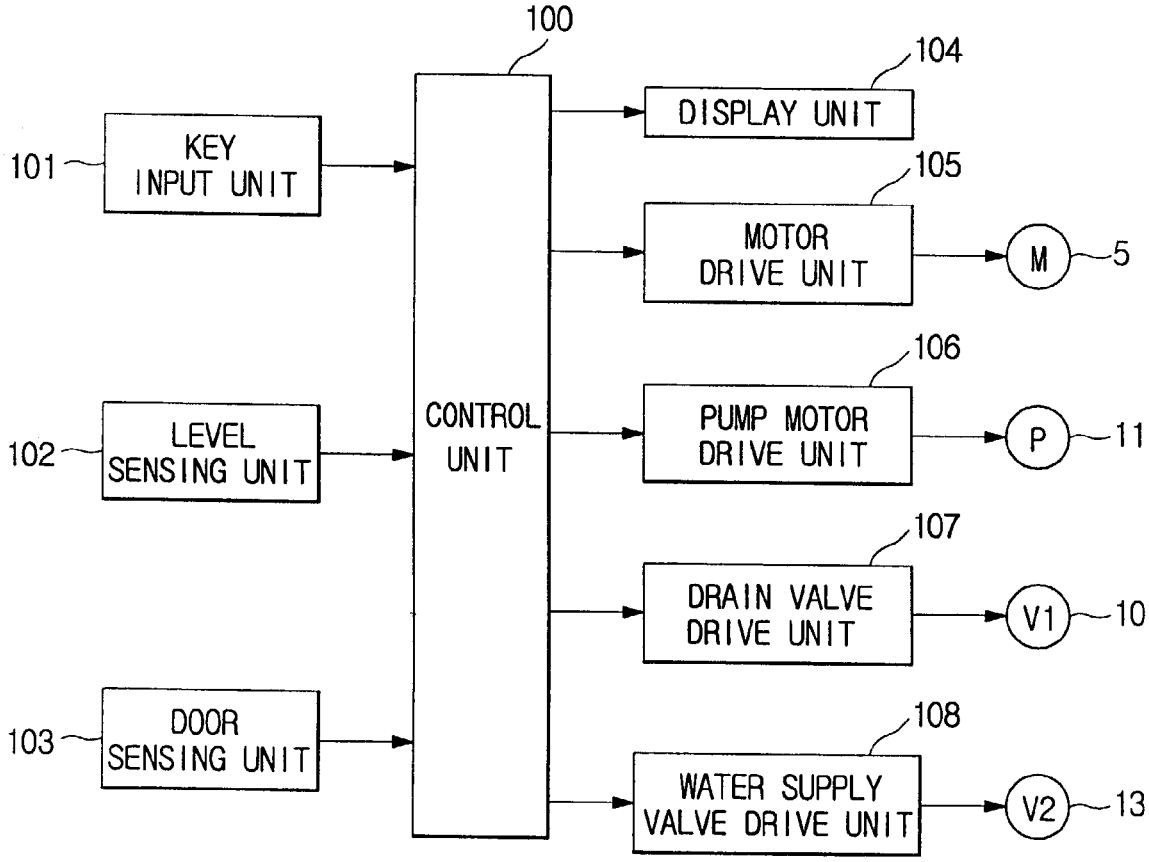
FIG. 2 is a block diagram illustrating components of the wobbling washing machine shown in FIG. 1.

FIG. 2 shows a block diagram illustrating components of the wobbling washing machine shown in FIG. 1.

As shown in the FIG. 2, the washing machine of FIG. 1 further includes a control unit 100 which controls the entire washing operation of the washing machine using the wobbling device 20. A key input unit 101, a level sensing unit 102, and a door sensing unit 103 are electrically connected to input terminals of the control unit 100. A user may input washing information, including a washing course, through the key input unit 101. The water-level sensing unit 102 senses the level of wash water in the water tub 2. The door sensing unit 103 senses whether a door 7 of the washing machine is open.

A display unit 104, a motor drive unit 105, a pump motor drive unit 106, a drain valve drive unit 107, and a water supply valve drive unit 108 are connected to output terminals of the control unit 100. In this case, the display unit 104 displays a current operating mode of the washing machine. The motor drive unit 105 drives the drive motor 5. The pump motor drive unit 106 drives the pump motor 11. The water supply valve drive unit 108 drives the water supply valve 13. The drain valve drive unit 107 drives a drain valve 10 of the washing machine.

Figure 3:
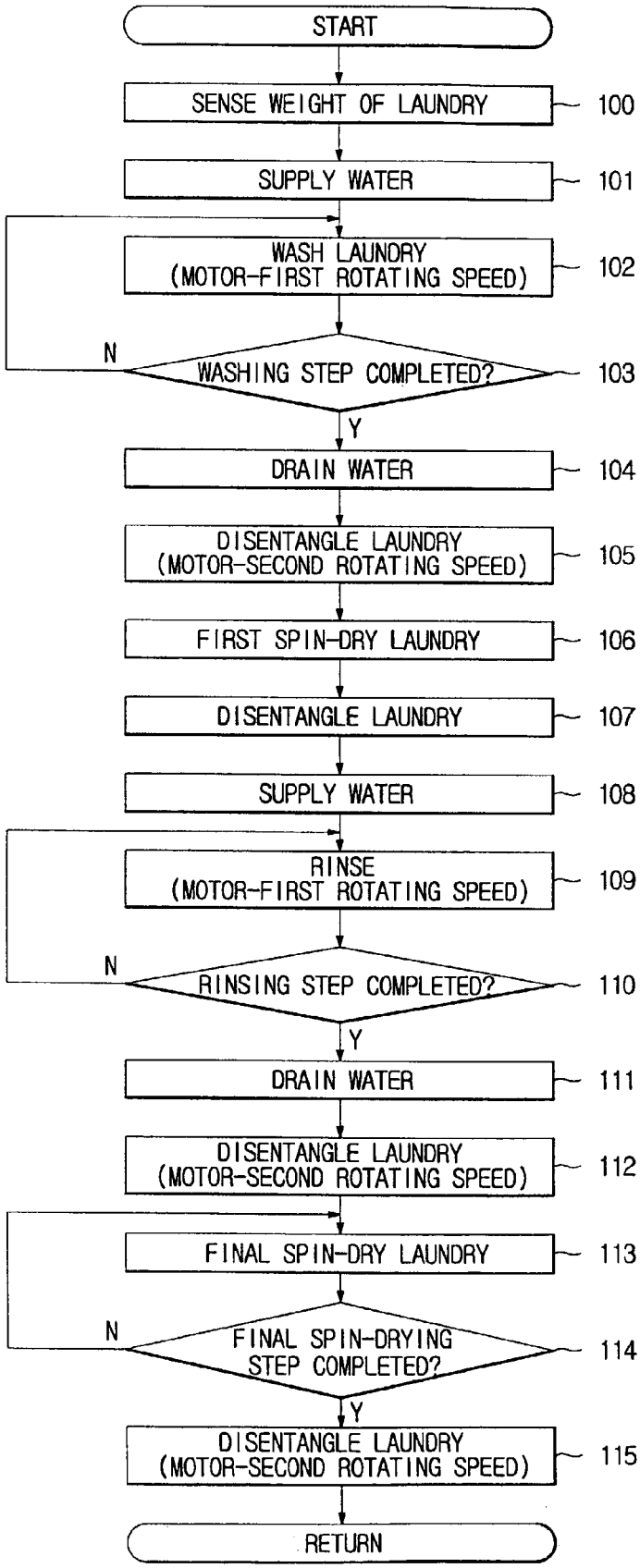
FIG. 3 is a flowchart illustrating a method of controlling the wobbling washing machine shown in FIG. 1.

FIG. 3 shows a flowchart illustrating a method of controlling the wobbling washing machine shown in FIG. 1.

A user may place the laundry and a detergent into the spin-drying tub 3 and input washing information through the key input unit 101.

As shown in FIG. 3, where the laundry is placed in the washing machine and the washing information is input, the control unit 100 senses a weight of the laundry in operation 100. The motor drive unit 105 rotates the drive motor 5 in response to a control signal transmitted from the control unit 100 to rotate the spin-drying tub 3 as the wobbling device 20 is maintained at its level position. The control unit 100 measures, using a sensor (not shown) which senses a speed of the drive motor 5, a time which is required for the motor 5 to reach a preset drive speed. Accordingly, the weight of laundry is determined based on the measured time. After finishing the determination of the weight of the laundry, the drive motor 5 is stopped.

Once the weight of the laundry has been determined, the control unit 100 sets a target water level corresponding to the weight of the laundry, and sends a control signal to the water supply valve drive unit 108 to open the water supply valve 13 and supply wash water to the water tub 2 in operation 101. The wash water is supplied to the water tub 2 until the water level sensed by the level sensing unit 102 reaches the target water level in the operation 101.

Where the water level reaches the target water level, the motor drive unit 105 rotates the drive motor 5 at a preset first rotating speed after converting a position of the wobbling device 20 to the wobbling position, in response to a signal transmitted from the control unit 100. As the drive motor 5 rotates, the washing plate 60 is wobbled in a vertical direction as it is inclined at a predetermined angle, thus washing the laundry by beating it in operation 102. The first rotating speed of the drive motor 5 is preset depending on the weight of the laundry.

During the washing operation, the control unit 100 counts a real washing time until it reaches a preset time, at which time the completion of the washing operation is determined in operation 103. Where the counted real washing time reaches the preset time and the washing operation is completed, the drain valve drive unit 107 opens the drain valve 10 to drain the wash water from the water tub 2, in response to a control signal transmitted from the control unit 100, so as to discharge dirty wash water to the outside through the drain hose 8 in operation 104.

Where the draining operation is completed, the control unit 100 rotates the drive motor 5 at a second rotating speed which is set to be higher than the preset first rotating speed so as to disentangle the laundry which is tangled during the washing operation in operation 105. In this case, the second rotating speed of the motor 5 may be variably preset according to the weight of the laundry. That is, the drive motor's rotating speed at a disentangling operation is preset to be higher/lower as the weight of the laundry is increased/decreased. However, the second rotating speed of the drive motor 5 is preset to be lower than the maximum rotating speed of the drive motor 5.

After disentangling the laundry, in response to a signal from the control unit 100, the position of the washing plate 60 is moved to the level position, and the washing plate 60 is rotated at a high speed along with the spin-drying tub 3 to perform a first spin-drying operation, in operation 106.

Once a preset spin-drying time has elapsed and the first spin-drying operation is completed, the control unit 100 sends a control signal to the motor drive unit 105. In response to the control signal, the motor drive unit 105 primarily stops the drive motor 5, and then rotates the drive motor 5 at the second rotating speed which is set to be higher than the first rotating speed of the motor 5, thus disentangling the laundry entangled during the first spin-drying operation, in operation 107.

After disentangling the load of laundry, the control unit 100 sends a control signal to the water supply valve drive unit 108 to open the water supply valve 13 and supply wash water to the water tub 2 until the water level reaches the preset water level, dependent on the weight of the laundry, in operation 108.

Where the water supply is completed, the control unit 100 sends a control signal to the motor drive unit 105. After moving the washing plate 60 to the wobbling position in the same manner as in the washing operation, the motor drive unit 105 rotates the drive motor 5 at the first rotating speed which is preset at the washing operation, and wobbles the washing plate 60 at a predetermined angle to perform a rinsing operation, in operation 109. The rinsing operation may be performed, for example, three times.

Where the rinsing operation is completed, the control unit 100 counts a number of rinses, and checks whether the counted number of rinses reaches a preset number, thus determining the completion of the rinsing operation, in operation 110.

Where the number of rinses reaches the preset number and the rinsing operation is completed, the control unit 100 sends control signals to the motor drive unit 105 to stop the drive motor 5, and to the drain valve drive unit 107 to open the drain valve 10, so as to discharge the dirty wash water to the outside through the drain hose 8 in operation 111.

Where the draining operation is completed, the control unit 100 sends a control signal to the motor drive unit 105 to rotate the drive motor 5 at the second rotating speed, thus disentangling the laundry which is entangled during the rinsing operation, in operation 112. The second rotating speed is set to be higher than the first rotating speed of the motor 5 which is preset at the rinsing operation.

Where the disentanglement operation 112 is completed, and in response to a control signal of the control unit 100, the drive motor 5 is rotated with the spin-drying tub 3 at a preset high speed so as to spin-dry the laundry after adjusting the position of the washing plate 60 to the level position, thus performing a final spin-drying operation, in operation 113.

During the final spin-drying operation, the control unit 100 measures a real spin-drying time until it reaches a preset time, and determines whether the final spin-drying operation is completed in operation 114.

Where the counted real spin-drying time reaches the preset time and the final spin-drying operation is completed, the control unit 100 sends a control signal to the motor drive unit 105 to stop the drive motor 5. Thereafter, the drive motor 5 is rotated again at the second rotating speed by the motor drive unit 105, thus disentangling the laundry which is entangled during the final spin-drying operation, in operation 115. In this case, the second rotating speed is set to be higher than the first rotating speed which is preset at the washing and rinsing operations.

Where the disentanglement operation 115 is completed, the control unit 100 sends a control signal to the motor drive unit 105 to stop the drive motor 5, thus finishing the entire washing operation.

It is understood that a system which uses the present invention also includes permanent or removable storage, such as magnetic optical discs, RAM, ROM, etc., on which the process and data structures of the present invention can be stored and distributed. The operations can also be distributed via, for example, downloading over a network such as the Internet.

As described above, the present invention is directed to effectively disentangling a tangled laundry by wobbling a washing plate at a motor's rotating speed which is preset to be higher than a motor's rotating speed at a washing or a rinsing operation.

In the present invention, entanglement of the laundry is minimized by performing a disentangling operation before and after each of a first spin-drying operation and a final spin-drying operation.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A method of controlling a wobbling washing machine having a washing plate and a motor which wobbles the washing plate, the method comprising:

performing a washing operation to wash laundry, including wobbling the washing plate;

performing a rinsing operation to rinse the laundry, including wobbling the washing plate; and performing a disentangling operation to disentangle the laundry by wobbling the washing plate, wherein the wobbling of the washing plate during the disentangling operation is performed at a higher wobbling speed than that of the rinsing or the washing operation.

2. The method according to claim 1, further comprising performing a spin-drying operation to spin-dry the laundry, wherein the disentangling operation is performed before and after the spin-drying operation.

3. The method according to claim 2, further comprising performing a final spin-drying operation to spin-dry the laundry, wherein the disentangling operation is performed before and after the final spin-drying operation.

4. The method according to claim 1, wherein the motor is rotated according to a preset rotating speed, and has a rotating speed at the disentangling operation, which is preset to be higher than a motor's rotating speed at the washing or the rinsing operation.

5. The method according to claim 4, wherein the rotating speed at the disentangling operation is variably preset according to a weight of the laundry.

6. The method according to claim 5, wherein the rotating speed at the disentangling operation is preset to be higher in response to the weight of the laundry being increased.

7. The method according to claim 4, wherein the rotating speed at the disentangling operation is preset to be higher than the motor's rotating speed at the washing or the rinsing operation, and lower than a maximum rotating speed of the motor.

8. The method according to claim 1, further comprising sensing a weight of the laundry according to a time required for the motor to reach a preset drive speed.

9. A method of controlling a washing machine having a washing plate and a motor which drives the washing plate, the method comprising:

performing a washing operation to wash laundry;

performing a rinsing operation to rinse the laundry; and performing a disentangling operation to disentangle the laundry, wherein:

the washing plate is driven by the motor during the washing, rinsing and disentangling operations, and the driving of the motor during the disentangling operation is performed at a higher speed than that of the washing or the rinsing operation.

10. The method according to claim 9, further comprising performing a spin-drying operation to spin-dry the laundry, wherein the disentangling operation is performed before and after the spin-drying operation.

11. The method according to claim 9, wherein the motor is rotated according to a preset rotating speed, and has a rotating speed at the disentangling operation, which is preset to be higher than a motor's rotating speed at the washing or the rinsing operation.

12. The method according to claim 11, wherein the rotating speed at the disentangling operation is variably preset according to a weight of the laundry.

13. The method according to claim 12, wherein the rotating speed at the disentangling operation is preset to be higher in response to the weight of the laundry being increased.

14. The method according to claim 13, wherein the rotating speed at the disentangling operation is preset to be higher than the motor's rotating speed at the washing or the rinsing operation, and lower than a maximum rotating speed of the motor.

* * * * *